US005423238A

United States Patent [19]

Bory

[11] Patent Number: 5,423,238

[45] Date of Patent: Jun. 13, 1995

[54] METHOD AND APPARATUS FOR PRECISION CUTTING OF CORRUGATED CARDBOARD AND REFERENCE ROD ASSEMBLY THEREFOR

[75] Inventor: William H. Bory, Baltimore, Md.

[73] Assignee: Chesapeake Corporation, Baltimore, Md.

[21] Appl. No.: 127,542

[22] Filed: Sep. 28, 1993

Related U.S. Application Data

[63] Continuation-in-part of Ser. No. 896,780, Jun. 10, 1992, Pat. No. 5,325,752.

[51] Int. Cl.[6] ..... B26D 7/01

[52] U.S. Cl. ..... 83/36; 83/455; 83/468.4; 83/614; 83/620; 269/47

[58] Field of Search ..... 83/36, 39, 455, 468.1, 83/468.4, 471.2, 614, 620, 704, 465; 269/291, 295, 47

[56] References Cited

U.S. PATENT DOCUMENTS

| | | | |
|---|---|---|---|
| 179,645 | 7/1876 | Cassidy . | |
| 289,594 | 12/1883 | Zieger . | |
| 2,409,203 | 10/1946 | Gale . | |
| 2,835,037 | 5/1958 | Middents | 83/614 X |
| 3,130,622 | 4/1964 | Eno . | |
| 3,213,736 | 10/1965 | Keeton . | |
| 3,354,769 | 11/1967 | Abramson et al. . | |
| 3,513,744 | 5/1970 | Hershberger . | |
| 3,527,131 | 9/1970 | Ellerin . | |
| 4,590,834 | 5/1986 | Sobel . | |
| 4,641,556 | 2/1987 | Vigneron et al. . | |
| 4,662,258 | 5/1987 | Mood . | |
| 4,738,177 | 4/1988 | Jones, III et al. . | |
| 4,858,507 | 8/1989 | Evans et al. . | |
| 5,086,680 | 2/1992 | Johnson . | |
| 5,127,294 | 7/1992 | Mohr . | |
| 5,146,823 | 9/1992 | Holmes . | |

*Primary Examiner*—Kenneth E. Peterson
*Attorney, Agent, or Firm*—Lowe, Price, LeBlanc & Becker

[57] ABSTRACT

A cutting instrument includes a base plate and a pair of cutting blades slidably mounted to the base with a slide block and rail system for cutting movement. A reference rod assembly is provided to maintain the internal flutes of a corrugated paper board in parallel relationship to the cutter blades during cutting to ensure first and second cut edges which are precisely parallel to the flutes. The reference rod assembly comprises two pairs of parallel reference rods which project in a common plane from a key stock plate. The distal ends of these rods, after respectively passing through flutes in the paper board to be cut, are adapted to be received in blind bores formed in a side surface of a guide rail to support the reference rods on the rail. The key stock plate further includes a pair of parallel positioning pins which are received in a pair of bores formed in a side edge of the base plate. The reference rods are thereby secured at their opposite ends to maintain the desired parallelism between the flutes and cutter blades during cutting. A method of precision cutting utilizing a reference rod clamping arrangement is also disclosed.

27 Claims, 4 Drawing Sheets

METHOD AND APPARATUS FOR PRECISION CUTTING OF CORRUGATED CARDBOARD AND REFERENCE ROD ASSEMBLY THEREFOR

RELATED APPLICATIONS

The present application is a continuation-in-part of application Ser. No. 896,780, filed Jun. 10, 1992, now U.S. Pat. No. 5,325,752, entitled "Cutter Instrument for Precision Cutting of Rectangular Shapes from a Corrugated Cardboard Sheet," assigned to the assignee of the present invention, Chesapeake Corporation, of Baltimore, Md.

TECHNICAL FIELD

The present invention relates generally to paper cutting and, more particularly, to a cutter instrument for precision cutting of rectangular shapes of corrugated paper board from sheet stock to conduct edge crush and other types of testing.

BACKGROUND ART

Corrugated cardboard is commonly used in the manufacture of shipping cartons having a wide variety of uses. The manufacturing of corrugated cardboard and the manufacturing of the cartons themselves are both well known and form no part of the present invention. However, in the manufacture of corrugated cartons, it is customary to determine the compression strength of the corrugated carton by edge crush testing of precision cut samples that are typically of square or rectangular dimensions. Such samples are also used for other well known types of testing. Heretofore, such samples were cut by hand, such as with a razor, knife or saw, or formed with a die.

Such prior art methods are not completely reliable since the cut, and the precision thereof, varies with the manual skill of the cutter. If the resulting cut is not square, i.e., the edges are not parallel or the cut edge itself is bevelled, it will be difficult to conduct a reliable crush test.

To obtain precision cut samples, my aforesaid copending '780 application, now U.S. Pat. No. 5,325,752, the disclosure of which is hereby incorporated by reference herein in its entirety, discloses a precision cutter the salient features of which are disclosed in FIG. 1 of the present drawing. Therein, the cutter 10 comprises a base plate or table 11 and a pair of cutting blades 18,20 slidably mounted to the base plate with a slide block 80 and rail system 60 for cutting movement in a direction parallel to a first guide rail 12. A pair of second guide rails 22 and 24 are spaced from each other by the predetermined distance between the pair of cutting blades 18,20 to allow the strip which has first and second cut edges simultaneously cut with the first blades to be rotated 90° and positioned between the second guide rails in abutting contact therewith. Movement of the cutter blades along the cutting path completes the cutting of the strip into a precise square.

As mentioned above, the square or rectangular test panels are designed to be subjected to several different tests including an important edgewise compression test which should be performed perfectly, or precisely, parallel to the direction of the internal flutes or perfectly normal to the flute direction. To be able to produce reproducible, or duplicate, test results on similarly constructed paper board panels, it is necessary that the square or rectangular test specimen panels be uniformly and precisely cut, or formed, so that two of the test specimen panel edges are always precisely parallel to the flutes, and the other two specimen panel edges are always precisely normal to the flutes.

The hollow, internal flutes are located within the corrugated paper board panels, so that the flute direction is not always readily determined by a visual inspection of the uncut corrugated paper board panel. Nonetheless, it is possible to form a panel edge which runs approximately parallel to the flute direction, either by a trial and error process wherein the edge of the test specimen or sample is inspected after the first cut to determine the approximate extent of deviation from parallelism, or by using the heretofore described invention of FIG. 1 wherein the edge of the specimen from which a sample is being cut is first positioned against the first guide rail guide surface 12*a* which is precisely parallel to the cutting blades 18,20 and their direction of movement. Even with the invention of FIG. 1, however, the observer is never quite certain, from a visual inspection, whether or not the first cut is, in fact, exactly or precisely parallel to the internal flute direction. This is because the parallel cuts are being made with reference only to the extent to which the sample edge abutting the guide surface 12*a* is in fact precisely parallel to the internal flutes.

To obtain regular test specimens having cut edges which attempt to be precisely parallel or perpendicular to the internal flute, U.S. Pat. No. 5,146,823, issued Sep. 15, 1992 to Emerson Apparatus Company, Inc., Portland, Me., discloses a reference rod which is inserted through a selected flute in a corrugated paper board panel prior to the first cutting operation on the raw panel. The reference rod is then placed in a specific location on the cutting table surface so that opposite ends thereof project beyond the specimen edges to allow anchorage means on the table to engage these projecting ends to temporarily support the specimen on the surface with its flutes precisely oriented parallel to the path line for the cutter means. The anchoring means is disclosed as being magnets.

It is believed that numerous disadvantages inherent in the single reference rod and magnetic anchorage assembly disclosed in the '823 patent will occur that will cause the cutter system to function unreliably. For example, it is believed that the use of only a single reference rod may not maintain enough of a rigid clamping force to resist the friction and "twisting" or "torquing" affect which may occur as the cutting blade moves through the material. Consequently, it is theorized that the specimen could twist relative to the single reference rod, possibly resulting in a failure of the single rod to maintain parallelism between the flutes and the cutting blade. This problem may become even more pronounced since the frictional forces generated by a pair of cutters of the type depicted in FIG. 1 of the present specification would tend to be greater than the friction generated by the single circular cutter blade in the '823 patent.

In addition, since magnets are used in the '823 patent to anchor the opposite ends of the reference rod on the table surface, it is believed that this type of anchoring arrangement will result in crushing of the specimen at the points of anchorage and probable loss of parallelism as a result of such crushing.

It is accordingly one object of the present invention to obtain precision cut samples of corrugated cardboard to achieve reliable edge crush testing as well as other types of testing.

Another object is to provide a cutter for obtaining single or multiple precision cut samples of cut corrugated material wherein the cut edges are precisely parallel to the internal flutes in the corrugated material.

Yet a further object is to provide a method and apparatus for the precision cutting of corrugated material by initially orienting the material on a cutter support surface with reference to the fluted passages within the material and maintaining parallelism between these passages with the cutting surfaces of the cutter instrument.

Still another object is to provide a reference rod arrangement insertable respectively into plural flutes of the corrugated material to resist the frictional forces and a possible twisting or torquing effect acting on the material as the cutting surfaces advance through the material.

DISCLOSURE OF THE INVENTION

A cutter instrument for precision cutting a corrugated sheet object into a precision cut sample of predetermined dimensions, in accordance with the present invention, comprises a support base for supporting the sheet object for cutting, and a cutter including at least one cutting blade, mounted for movement on the support base. A reference rod assembly having a plurality of reference rods respectively insertable through different ones of flutes formed in the corrugated sheet object cooperates with a holding arrangement operatively connected to the rod assembly for securing the reference rods to the support base.

The holding arrangement is preferably a clamping arrangement for securing opposite ends of the reference rods to the support base.

The cutter preferably includes a pair of cutting blades being substantially parallel with and spaced a predetermined precision distance from each other for cutting the precision cut sample from the sheet object. The feature of two cutting blades minimizes the number of cuts, and therefore error, necessary to form the sample.

The cutter instrument, in accordance with another feature of the invention, preferably includes a guide mounted on the support base and which extends generally perpendicular to the moving direction of the cutter. The guide includes a guide surface against which the sheet object is positioned for predetermined alignment with the cutting blades following initial cutting of the first pair of parallel cut edges under the alignment and clamping action of the reference rod assembly.

In the preferred embodiment, the reference rod assembly preferably includes a key stock plate from which first common or proximal ends of the plural reference rods project substantially parallel to each other and in perpendicular relationship to the key stock plate. The guide surface includes a plurality of anchoring holes respectively adapted to receive the distal ends of the plural reference rods after the rods respectively pass through internal flutes within the corrugated sheet object to thereby secure the distal ends to the support base. The longitudinal axes of the anchoring holes are machined to be precisely parallel to the cutting paths of the blades.

To secure the proximal ends of the plural reference rods to the support base and thereby provide a rigid clamping mechanism for holding the sheet object in a predetermined operative alignment with the cutter, the key stock plate further includes a first anchoring portion connectable to a second anchoring portion on the support base. The first anchoring portion preferably includes at least one positioning pin projecting from the key stock plate, vertically spaced beneath the proximal ends of the plural reference rods, and the second anchoring portion is an anchoring hole formed in a side edge of the base plate. This anchoring hole is also machined with a longitudinal axis extending precisely parallel to the cutting paths.

Preferably, at least a pair of the positioning pins are provided in the key stock plate to be respectively received in a pair of anchoring holes formed in the base plate side edge.

Since the anchoring holes are machined in the guide edge and the base plate side edge precisely parallel to each other as well as the direction of cutting movement, the reference rod assembly provides a reliable and easy to use system for insuring that the cut edges of the sample are parallel to the internal flutes. The feature of providing plural reference rods or an equivalent system which provides multiple anchoring points along opposite edges of a sheet object being cut, advantageously minimizes the likelihood of the sheet from twisting or "torquing" out of its plane as a result of frictional forces generated during cutting movement.

The guide preferably includes a guide rail arrangement and the guide surface is a vertical face of the arrangement extending perpendicular to the direction of movement of the cutter. The guide rail arrangement extends across the cutting path of the cutting blades and is formed to define cutting grooves extending through the guide rail arrangement which establish an uninterrupted, continuous path through which the cutting blades respectively move through the guide rail arrangement during cutting. The cutter instrument of this invention may also further comprise an anvil plate extending continuously along the cutting path between the cutting blades. The anvil plate thereby presents a pair of uninterrupted, continuous side edges along which the cutting blades move during cutting contact with the sample juxtaposed on the anvil plate.

A guide rail arrangement may include at least first and second separate guide rail portions. The second guide rail portion is mounted on the anvil plate in spaced relation to the first guide rail portion to define one of the cutting grooves therebetween. Optionally, a third separate guide rail portion may be mounted with the second guide rail interposed between it and the first rail portion.

The cutter is preferably mounted on the support base through a bearing arrangement which is fixed to the support base and along which the cutter is slidably moveable. The bearing arrangement includes a mounting panel secured to the base at opposite ends thereof. An intermediate portion of the mounting panel extends in elevated position above the base to enable a portion of the sheet object to be disposed beneath the mounting panel to facilitate proper alignment of a predetermined portion of the sheet object with the cutter.

The bearing arrangement, in the preferred embodiment, further includes a pair of mounting arms respectively extending upwardly from the mounting panel along longitudinal edges thereof. A track is formed at the upper end of each mounting arm and is suspended above the support base via a connecting web.

The cutter includes a pair of slide blocks respectively formed with a slide channel having a cross section corresponding to the cross section of the tracks for interfitting sliding engagement therewith. A cutting block includes means for clamping the cutting blades to it so that cutting portions of each blade project downwardly from the block. The block is formed with a pair of blade receiving recesses respectively in parallel side faces thereof. The clamping means includes clamping blocks secured to the side faces of the cutting block to clamp the blades therebetween.

The present invention also encompasses a method for precision cutting a piece of corrugated cardboard into a rectangular test specimen utilizing a cutter instrument having a cutter including at least one cutting blade movably mounted on the support base. According to the invention, the method comprises the steps of positioning the piece of corrugated cardboard on the support base by inserting a plurality of reference rods through respective ones of the internal flutes in the cardboard and securing opposite ends of the reference rods to the support base. A cut line is then cut in the piece by moving the cutting blade through the piece to form a cut edge of the test specimen.

According to the method, the cutting step preferably includes cutting a pair of parallel cut lines in the piece by simultaneously moving a pair of said cutting blades through the piece to form a pair of parallel cut edges of the test specimen.

After the aforesaid cutting occurs, the reference rods are then removed from the internal flutes. Next, the piece containing the parallel cut edges is positioned against a guide extending perpendicular to the path of the cutting blades with one of the parallel cut edges against the guide. A second pair of parallel cut lines are then cut through the portion by simultaneously moving the cutting blades therethrough to intersect the first pair of parallel cut lines and thereby form the test specimen which will now have two pairs of parallel cut edges.

To ensure that each cut edge is precisely square with the top and bottom surfaces of the corrugated board, each blade is a flat blade on one side thereof. It is this flat blade surface which faces towards the precision cut sample with the beveled cutting edge, on the opposite side of the blade, facing the resulting scrap material being cut.

The above and still further objects, features and advantages of the present invention will become apparent upon consideration of the following detailed description of a specific embodiment thereof, especially when taken in conjunction with the accompanying drawings.

BEST MODE FOR CARRYING OUT THE INVENTION

Figure 2:
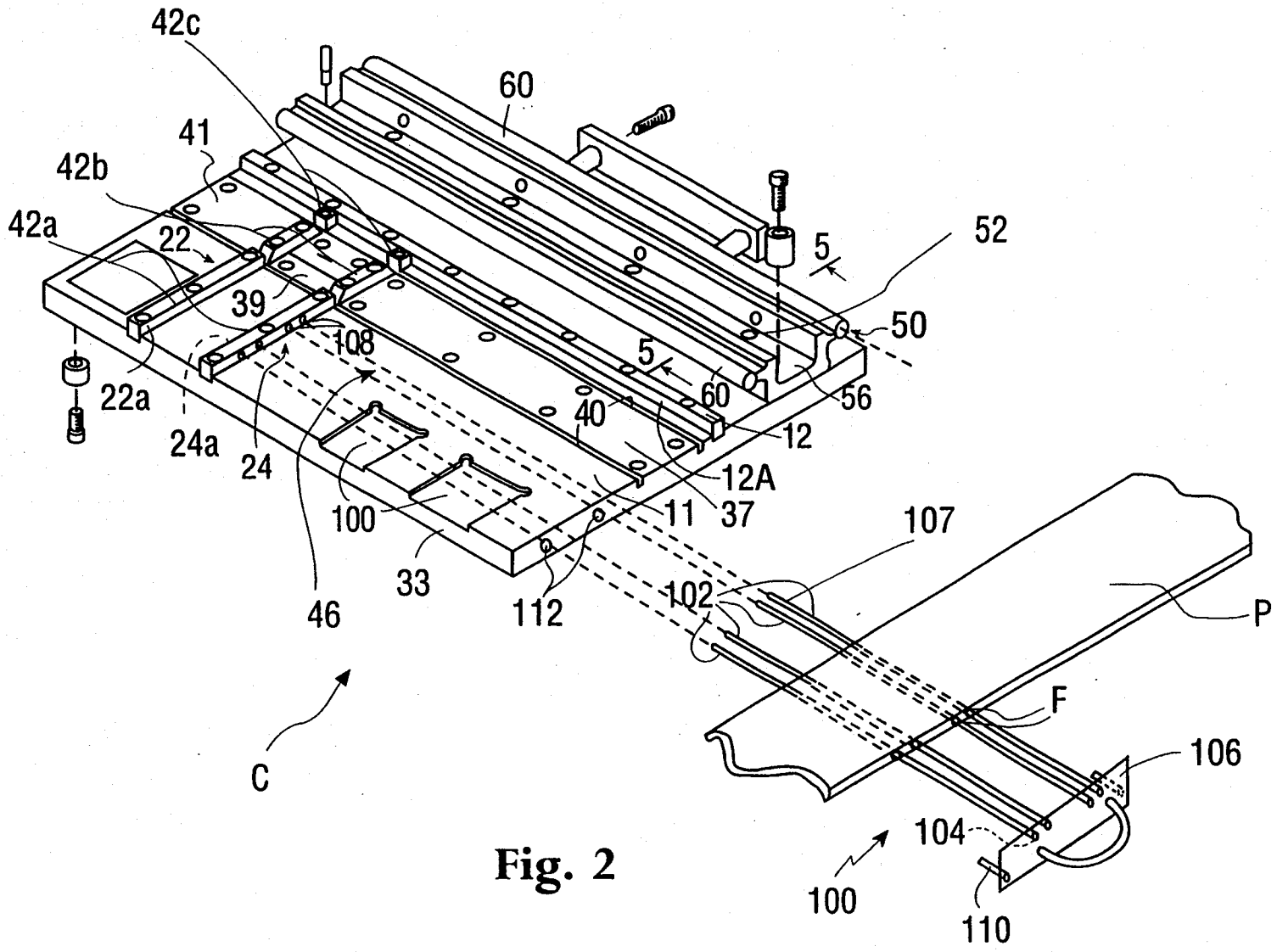
FIG. 2 is a perspective view of an embodiment of my present invention.

FIG. 2 is an illustration of an embodiment of the present invention, preferably used for cutting a sheet of corrugated cardboard P into a precision cut square or rectangle useful for edge crush testing to determine the compression strength of a corrugated box. The cutter instrument C features a multiple reference rod assembly 100 comprising two pairs of parallel reference rods 102 which are coplanar with each other and attached, at first common or proximal ends 104 thereof, to project from a key stock plate 106 in perpendicular relation thereto. In operation, the distal ends 107 of these four reference rods 102, are inserted with a frictional fit into four corresponding aligned internal flutes F of a corrugated paper board P to be cut. After distal ends 107 respectively pass through the four flutes F, they are adapted to be received in blind bores 108 formed in a side surface of a guide rail 24 which extends perpendicular to a cutter assembly (not shown in FIG. 2). The key stock plate 106 further includes a pair of parallel positioning pins 110 projecting from the key stock, vertically spaced beneath the reference rods 102, to be respectively received in a pair of parallel bores 112 formed in a side edge of the base plate 11. In this manner, the multiple reference rods 102, the longitudinal axes of blind bores 108 and 112, are precisely parallel to the blade or blades of the cutter assembly as well as the internal flutes F of the paper board P to be cut. The cutting block assembly is then manually slid via gripping handle 16 from left to right to enable a pair of cutting blades 18 and 20 to cut from the sheet a strip having a precision cut width W defined by the distance between the cutting blades.

The reference rod assembly 100 is then removed from the internal flutes. One of the cut edges is then positioned firmly against the vertical guide surface of the guide rail. The cutting block assembly 14, having been returned to the home position, (i.e., upper left hand corner in FIGS. 2–4 on the opposite side of the guide rail), is once again slid from left to right to cut the strip into a square having nominal precision cut dimensions of W×W.

Figure 1:
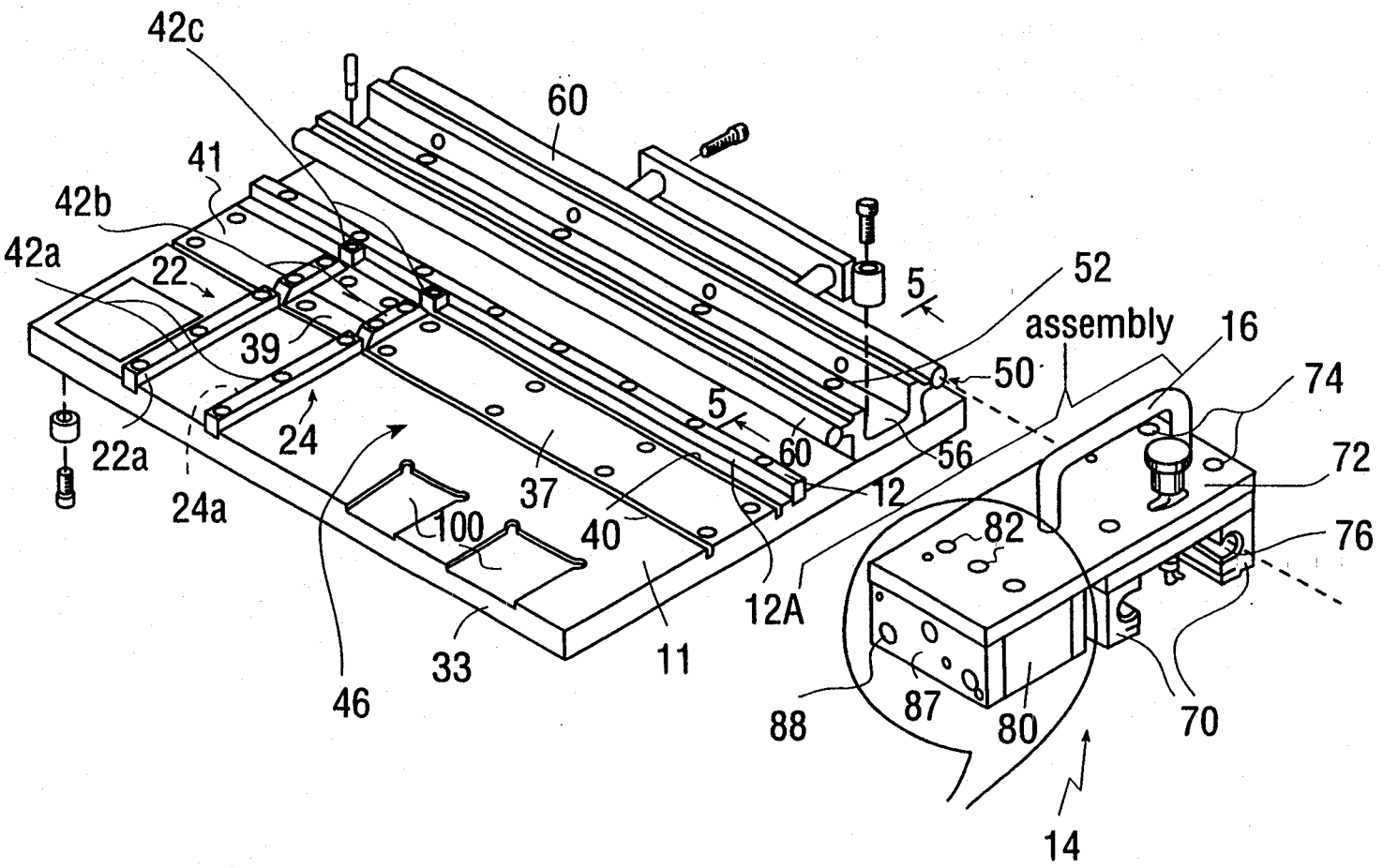
FIG. 1 is a partial exploded perspective view of a precision sample cutter in accordance with a preferred embodiment of my prior invention.

The base plate is rectangular in plan view and preferably may be identical in construction to base plate 11 in FIG. 1. Therefore, a channel of elongate rectangular cross section is formed in the upwardly directed flat surface of the base plate and extends longitudinally the full length of the plate. Unlike plural anvil plates in the FIG. 1 embodiment, however, a single flat, elongate anvil plate 37 (e.g., hardened steel) is bolted within this rectangular channel, to extend the full length of plate 11, with counter-sunk screws so that the resulting upper flat surface of the anvil plate is flush with surrounding upper surface of the base plate 11. The width of the channel is slightly greater than the corresponding width of the anvil plate to define a pair of grooves through which the cutting edges of the cutting blades 18,20 travel during cutting movement.

More specifically, the guide rail is actually comprised of first, second and third guide rail sections **42*a*,42*b*,42*c* which are bolted to the base plate with screws 62. Each of the first, second and third guide rail sections has a vertical guide wall or surface which are coplanar to define a guide surface against which one of the cut edges of the sample will be positioned to cut the third and fourth edges of the sample during the second pass of the cutter assembly. The second guide rail section 42*b* is bolted to the top surface of the anvil plate 37 between the first and third guide rail sections 42*a*,42*c* and has its opposite ends spaced from the opposing ends of the first and third rail sections across the width of the cutting grooves. In this manner, the longitudinal edges of the anvil plate 37 extend the full length of the cutting path in a continuous, uninterrupted manner, which advantageously prevents the cutting blades 18,20 from being chipped as occurred in the prior invention wherein the anvil plate was formed into separate sections with one section thereof interposed between the second rail sections 42***b*.

The slide track 50 along which the cutter assembly is mounted may be identical to the slide track of FIG. 1, and comprises a elongate central mounting base section formed with through-holes at opposite ends with vertical through-holes at opposite ends thereof. These through-holes are aligned with through-bores formed respectively in a pair of rectangular spacers sandwiched between the upper surface of the support plate and the lower surface of the mounting base section to space the bottom surface of the mounting base from the upper surface of the support plate for advantageous purposes described hereinafter. A pair of slide mounting arms project upwardly from the longitudinal edges of the mounting base section, perpendicular thereto, to respectively define a bearing track of cylindrical cross sections separated from the associate upright arm with a thin web section. In this manner, each track is suspended above the base plate upper surface in parallel relation to the cutting grooves through which the cutting blades 18,20 travel.

The cutting block assembly 14, as best depicted in FIG. 6 of my prior '780 application, incorporated herein by reference, comprises a pair of slide blocks 70 (see FIG. 1) mounted in spaced relation to each other to the bottom surface of a top plate 72 by means of screws 74 passing downwardly through the top plate into the upper surface of each slide block. Each slide block 70 is of rectangular cross-section to define, in a vertical inward facing surface thereof (opposing a like surface of the other slide block), a groove 76 extending along the entire inner surface to intersect the front and rear faces of the slide block. Each groove 76 is formed with a cross-section corresponding to that of the cylindrical track 60 and is adapted to receive a corresponding one of the tracks and be supported thereby for sliding movement along the base plate 11. Each slide block 70 is dimensioned so that the cutting block assembly 14 is solely supported on the base plate 11 by means of the aforesaid slide track arrangement.

The cutting block assembly 14 further comprises a cutter blade holder 80 which is also bolted to the top plate 72 by means of screws 82 passing through the top plate into the upper surface of the block adjacent the innermost ones of slide blocks 70. The cutter blade holder 80 is of rectangular cross-section and formed with a pair of parallel vertical sides each containing a blade mounting recess. Cutting blades 18,20 are respectively disposed in each recess and secured therein by means of a pin 85 and a clamping plate 87 bolted to the associated side face of the holder 80 with screws 88 received in threaded bores. A recess formed in each clamping plate 87 receives a portion of each blade 18,20 in cooperation with the opposing recess. Each cutting blade 18,20 has a cutting edge 90 extending downwardly from the cutting block. Handle 16 is attached to the top surface of the top mounting plate 72 to enable manual sliding of the cutting block assembly 14 along the slide tracks 60 in the aforesaid manner.

With the foregoing construction of the invention, the cutting edges 90 are set to a predetermined spacing W corresponding to the spacing between the cutting grooves 34,36 through which the exposed blade edges 90 travel during sliding and cutting movement. The predetermined, precision distance W between cutting edges 90 is advantageously maintained via sliding, scissors-like cutting contact between the blade cutting edges and the longitudinal edges of the anvil plate 37. In this manner, a sheet object positioned between the cutting grooves 34 and 36 on the anvil plate 37 is precisely cut into a longitudinal strip of precision width W as the cutting block assembly 14 is slid along the tracks 60 as aforesaid. After cutting, this longitudinal strip is positioned between the second guide rails 22,24 for cross-cutting into a precision cut square suitable for edge crush testing.

Figure 3:
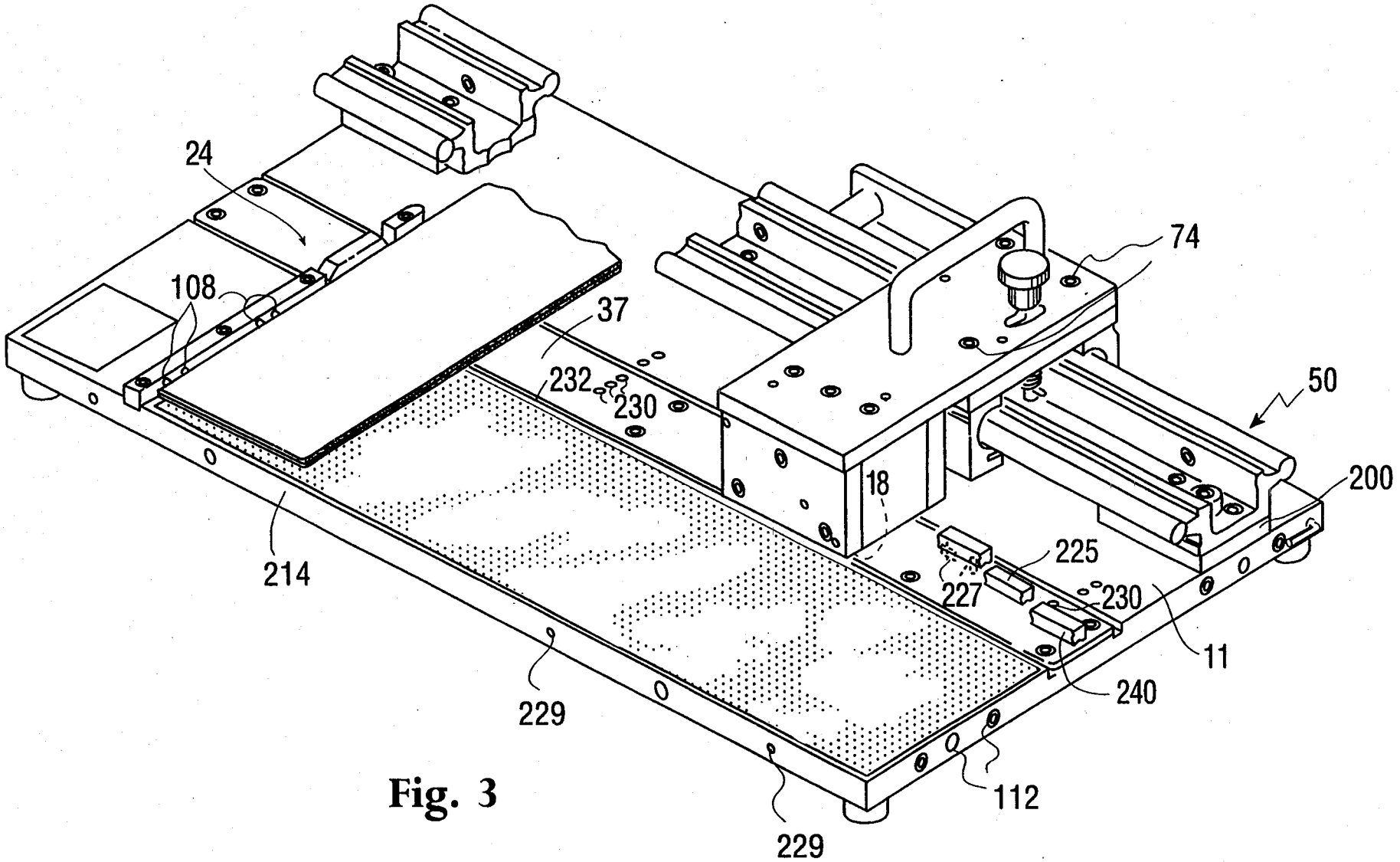
FIG. 3 is a perspective view depicting a preferred embodiment in accordance with this invention with the reference rod assembly omitted for simplicity of drawing.

FIG. 3 is an illustration of a preferred embodiment of the invention with the reference rod assembly 100 omitted for simplicity of drawing. In the FIG. 3 embodiment, unlike the FIG. 2 embodiment, it is to be noted that the slide track 50 and the cutter assembly are identical to that depicted in FIG. 2 with the exception that the slide track is mounted in elevated position above the surface of base plate 11 by means of blocks 200 disposed between the mounting base section 56 and the upper surface of the base plate only at opposite ends thereof.

Since the cutter block assembly is now supported on an elevated slide track as in the present invention, the cutting block can be easily removed from the slide block assembly without removing the entire bearing slide track, simply by unscrewing the mounting screw members depicted in FIG. 3. In this manner, one or both of the cutting blades may be easily replaced.

In the preferred embodiment of FIG. 3, unlike the FIG. 2 embodiment, only one guide rail 24 is provided instead of guide rails 22 and 24 as in FIG. 2.

Figure 4:
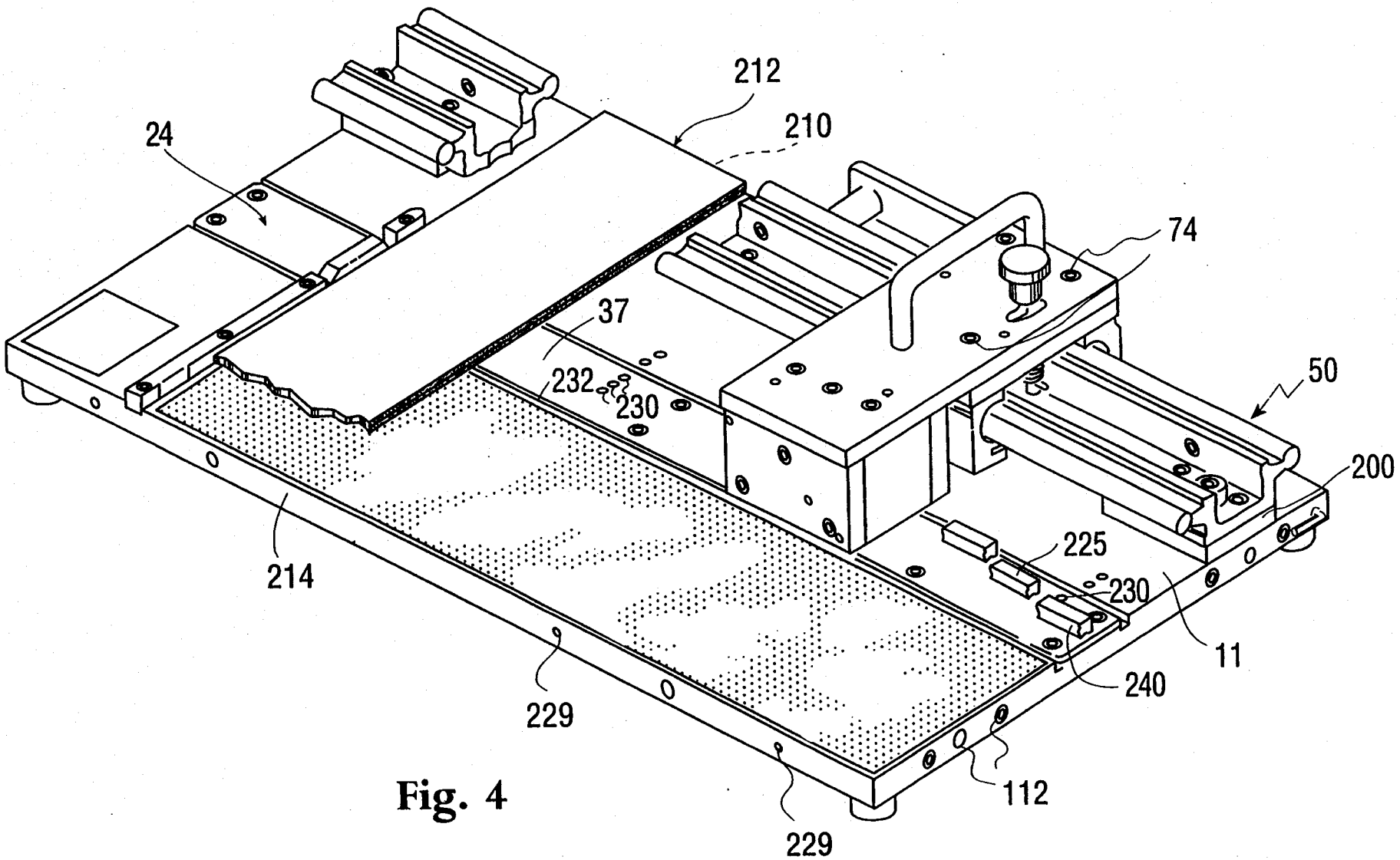
FIG. 4 is a perspective view depicting an additional use of the preferred embodiment.

With reference to FIG. 4, the feature of elevating the slide track above the upper surface of the support plate 11 now advantageously allows the longitudinal edge 210 of the support plate located remote from the cutter assembly to be used as an alignment edge. That is, the support plate is preferably formed so that this longitudinal alignment edge 210 is a predetermined distance from the closest cutting blade thereto. In the preferred embodiment, the predetermined distance is 6 inches. After a single cut edge 212 is formed in a sheet object by first using the reference rod assembly 100 in the aforesaid manner, this cut edge is then placed flush with the alignment edge 210 after first returning the cutter assembly to the home position. The cutter assembly is then advanced from left to right through the stock and material so that the cutting blade precisely cuts a rectangular section of material which is 6 inches in length.

The other longitudinal edge 214 of the support plate may also be spaced another predetermined distance from the closest cutting blade 18 thereto to allow for simultaneous cutting of another piece of material for use in a pin adhesion test requiring, for example, a strip 5 inches in length.

In accordance with yet another feature of this invention, there is provided a moveable guide rail 225 of rectangular cross section which may have the same rectangular cross sectional dimensions as the first, second and/or third guide rail sections 24*a–c*. A plurality of pins 227 project from a common bottom side of this moveable guide 225 and are adapted to be received in corresponding bores 229 located in one of the longitudinal edges of the support plate 11 which respectively receives the pins in friction fitting engagement to allow for storage of the moveable guide when not in use. With particular reference to FIGS. 3 and 4, a plurality of series of longitudinally spaced vertical bores 230 are provided in the anvil 37 between the cutting grooves in predetermined spaced relation from the first groove 232. By first returning the cutter assembly to the home position, the moveable guide 225 may then be drop mounted into one of the series of parallel bores to define a vertical guide surface 240 spaced a predetermined distance from the cutting blade 18 traveling through the groove 232 so that samples of different dimensional sizes (other than that defined by the fixed longitudinal edges 210,214 of the support plate relative to their associated cutting grooves) may be obtained (e.g., 1, 1¼, 1½ inches) with the cutter instrument of this invention.

While there has been described and illustrated one specific embodiment of the invention, it will be clear that variations in the details of the embodiment specifically illustrated and described may be made without departing from the true spirit and scope of the invention as defined in the appended claims.

I claim:

1. A cutter instrument for precision cutting a corrugated sheet object into a precision cut sample of predetermined dimensions, comprising:

a support base for supporting said sheet object for cutting;

a cutter mounted for movement on said support base and including at least one cutting blade;

a reference rod assembly having a plurality of reference rods respectively insertable through different ones of flutes formed in said corrugated sheet object; and a holding arrangement operatively connected to said reference rod assembly for securing said reference rods to said support base, further comprising a guide mounted on said support base and extending generally perpendicular to the moving direction of said cutter and including a guide surface against which said sheet object is positioned for predetermined alignment with said cutting blades following initial cutting of the first pair of parallel cut edges under the alignment and securing action of said reference rod assembly, wherein said reference rod assembly further includes a key stock plate from which first common or proximal ends of said plural reference rods project substantially parallel to each other and in perpendicular relationship to the key stock plate, and wherein said guide surface includes a plurality of anchoring holes respectively adapted to receive the distal ends of said plural reference rods after said rods respectively pass through internal flutes within the corrugated sheet object to thereby secure said distal ends to said support base.

2. The cutter instrument of claim 1, wherein said key stock plate further includes a first anchoring portion connectable to a second anchoring portion on said support base to secure the proximal ends of said plural reference rods to said support base and thereby provide a rigid clamping mechanism for holding the sheet object in a predetermined operative alignment with the cutter.

3. The cutter instrument of claim 2, wherein said first anchoring portion includes at least one positioning pin projecting from the key stock plate, vertically spaced beneath the proximal ends of said plural reference rods, and said second anchoring portion is an anchoring hole formed in a side edge of the base plate.

4. The cutter instrument of claim 3, further including at least a pair of said positioning pins respectively received in a pair of said anchoring holes formed in said side edge of the base plate.

5. A cutter instrument for precision cutting a corrugated sheet object into a precision cut sample of predetermined dimensions, comprising:

a support base for supporting said sheet object for cutting;

a cutter mounted for movement on said support base and including at least one cutting blade;

a reference rod assembly having a plurality of reference rods respectively insertable through different ones of flutes formed in said corrugated sheet object and a holding arrangement operatively connected to said reference rod assembly for securing said reference rods to said support base.

6. The cutter of claim 5, wherein said holding arrangement is a clamping arrangement for securing opposite ends of said reference rods to said support base.

7. The cutter of claim 6, wherein said cutter includes a pair of said cutting blades being substantially parallel with and spaced a predetermined precision distance from each other for cutting said precision cut sample from said sheet object.

8. The cutter instrument of claim 7, further comprising a guide mounted on said support base and extending generally perpendicular to the moving direction of said cutter and including a guide surface against which said sheet object is positioned for predetermined alignment with said cutting blades following initial cutting of the first pair of parallel cut edges under the alignment and securing action of said reference rod assembly.

9. The cutter instrument of claim 4, wherein the anchoring holes formed in said guide edge and in said side edge of the base plate are parallel to each other.

10. The cutter instrument of claim 8, wherein said guide includes a guide rail arrangement and the guide surface is a vertical face of said guide rail arrangement extending perpendicular to the direction of movement of said cutter.

11. The cutter instrument of claim 10, wherein said guide rail arrangement extends across the cutting path of the cutting blades and is formed to define cutting grooves extending through the guide rail arrangement which establish an uninterrupted, continuous path through which the cutting blades respectively move through the guide rail arrangement during cutting action.

12. The cutter instrument of claim 11, further comprising an anvil plate extending continuously along the cutting path between the cutting blades, said anvil plate thereby presenting a pair of uninterrupted, continuous side edges along which the cutting blades move during cutting contact with the sample extending above the anvil plate.

13. The cutter instrument of claim 12, wherein said guide rail arrangement includes at least first and second separate guide rail portions, said second guide rail portion being mounted on the anvil plate in spaced relation to the first guide rail portion to define one of said cutting grooves therebetween.

14. The cutter instrument of claim 8, further comprising a bearing arrangement mounted on said support base for movably mounting said cutter to said support base and for directing the movement of said cutter along said support base.

15. The cutter instrument of claim 14, wherein said cutter is slidably mounted to said support base through said bearing arrangement.

16. The cutter arrangement of claim 15, wherein said bearing arrangement includes a mounting panel secured to the base at opposite ends thereof, an intermediate portion of said mounting panel extending in elevated position above the base to enable a portion of the sheet object to be disposed beneath the mounting panel to facilitate proper alignment of a predetermined portion of said sheet object with the cutter.

17. The cutter instrument of claim 16, wherein said bearing arrangement further includes a pair of mounting arms respectively extending upwardly from the mounting panel along longitudinal edges thereof, and a track formed at the upper end of each mounting arm and suspended above the support base via a connecting web.

18. The cutter instrument of claim 17, wherein said cutter includes a pair of slide blocks respectively formed with a slide channel having a cross-section corresponding to the cross-section of the tracks for interfitting sliding engagement therewith; and a cutting block including means for clamping said cutting blades to said cutting block so that cutting portions of each blade project downwardly from the cutting block.

19. The cutter instrument of claim 18, wherein said cutting block is formed with a pair of blade receiving recesses respectively in parallel side faces thereof, and said clamping means includes clamping blocks secured to the side faces of the cutting block to clamp the blades therebetween.

20. The cutter instrument of claim 10, further comprising a second guide rail arrangement including a second guide rail detachably mountable to the support base at selected predetermined positions between the cutting paths of the respect cutting blades.

21. The cutter instrument of claim 5, wherein said reference rods are structured to have an interference friction fit with said flutes to prevent radial shifting movement of the flutes relative to the rods and thereby shifting movement of the corrugated sheet object out of parallel alignment with said at least one cutting blade during cutting.

22. A method for precision cutting a piece of corrugated cardboard into a rectangular test specimen utilizing a cutter instrument having a cutter including at least one cutting blade movably mounted on a support base, comprising the steps of:

a) positioning said piece of corrugated cardboard on said support base by inserting a plurality of reference rods through respective ones of internal flutes in said cardboard and securing opposite ends of said reference rods to said support base;

b) cutting a cut line in said piece by moving said cutting blade through said piece to form a cut edge of said test specimen.

23. The method of claim 21, wherein said cutter includes a pair of said cutting blades and wherein said cutting step includes cutting a pair of parallel said cut lines in said piece by simultaneously moving said cutting blades through said piece to form a pair of parallel cut edges of said test specimen.

24. The method of claim 22, comprising the further steps of removing said reference rods from said internal flutes after cutting; positioning at least a portion of said piece containing said parallel cut edges against a guide extending perpendicular to a path of said cutting blades; and cutting a second pair of parallel cut lines through said portion by simultaneously moving said cutting blades therethrough to intersect the first pair of parallel cut lines and thereby completely form said test specimen now having two pairs of parallel cut edges.

25. An apparatus for precision cutting of corrugated paper board panel specimens into rectangular shapes of predetermined size, wherein said corrugated specimens have parallel internal flutes extending across the entire specimen face area, said apparatus comprising a table defining a flat specimen support surface; a linear abutment projecting upward from said support surface; a cutter mounted for linear motion over said table on a linear path normal to said abutment; a plurality of reference rods extendable linearly through respective flutes of said specimen; and anchorage means for holding portions of said reference rods so that the specimen is temporarily supported on the table with its flutes precisely oriented relative to the path line of the cutter.

26. A method for precision cutting of corrugated paper board panel specimens into rectangular shapes of predetermined size, wherein said corrugated specimens have parallel internal flutes extending across the entire specimen face area, said method comprising the steps of extending at least a pair of linear reference rods respectively through at least a pair of flutes of said specimen so that opposite ends of each said reference rod projects beyond said specimens end edges; anchoring the opposite ends of each said reference rod to a table surface with the specimen lying flat over said surface; moving a cutter linearly across said table surface along a predetermined path line related to the direction taken by said reference rods, whereby said cutter forms a first straight edge on said specimen; positioning said specimen on said table surface with said first edge engaged against a linear abutment extending normal to the cutter path line; and moving said cutter another time to form another straight edge oriented at a right angle to said first straight edge.

27. A cutter instrument for precision cutting a corrugated sheet object into a precision cut sample of predetermined dimensions, comprising:

a support base for supporting said sheet object for cutting;

a cutter mounted for movement on said support base and including at least one cutting blade;

a reference rod assembly having a plurality of reference rods respectively insertable through different ones of flutes formed in said corrugated sheet object; and a holding arrangement operatively connected to said reference rod assembly for securing said reference rods to said support base, and further including a plurality of anchoring holes operatively positioned on the support base to receive distal ends of said reference rods to support same in position on the cutter instrument.

* * * * *